US006266502B1

(12) United States Patent
Matsuzaki et al.

(10) Patent No.: US 6,266,502 B1
(45) Date of Patent: Jul. 24, 2001

(54) PROCESS CARTRIDGE WITH CLEANING FRAME HAVING REINFORCING MEMBER

(75) Inventors: Hiroomi Matsuzaki, Mishima; Tadayuki Tsuda, Susono; Akira Suzuki, Odawara; Kazuo Chadani, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,686

(22) Filed: Oct. 22, 1999

(30) Foreign Application Priority Data

Oct. 26, 1998 (JP) ..... 10-321294

(51) Int. Cl.[7] ..... G03G 21/16

(52) U.S. Cl. ..... 399/111; 399/123; 399/358; 220/653

(58) Field of Search ..... 399/111, 113, 399/123, 360, 343, 358; 220/652, 653

(56) References Cited

U.S. PATENT DOCUMENTS

| | | | | |
|---|---|---|---|---|
| 5,221,943 | * | 6/1993 | Hasegawa | 399/111 |
| 5,809,374 | * | 9/1998 | Tsuda et al. | 399/111 |
| 5,884,124 | * | 3/1999 | Karakama et al. | 399/123 |
| 5,890,036 | * | 3/1999 | Karakama et al. | 399/119 |
| 5,953,561 | * | 9/1999 | Tashiro et al. | 399/111 |

FOREIGN PATENT DOCUMENTS 5-053384 * 3/1993 (JP) .

* cited by examiner

*Primary Examiner*—Robert Beatty
(74) *Attorney, Agent, or Firm*—Fitzpatrick, Cella, Harper & Scinto

(57) ABSTRACT

A cleaning frame used in a process cartridge which is detachably mountable to a main body of an electrophotographic image forming apparatus and which includes an electrophotographic photosensitive drum, and a cleaning member for removing developer adhered to the electrophotographic photosensitive drum, the process cartridge including a drum attaching portion for attaching the electrophotographic photosensitive drum, a cleaning member attaching portion for attaching the cleaning member, one end wall provided at one longitudinal end of the cleaning frame, the other end wall provided at the other longitudinal end of the cleaning frame, an exposure opening for receiving information light to be illuminated onto the electrophotographic photosensitive drum attached to the drum attaching portion when the process cartridge is mounted to the main body of the electrophotographic image forming apparatus, and a reinforcing member provided between the one end wall and the other end wall along the longitudinal direction of the cleaning frame said reinforcing member being disposed at a side opposite to the side at which the exposure opening is provided in the cleaning frame a direction transverse to the longitudinal direction of the cleaning frame, wherein a gap between said reinforcing member and a deep side wall opposed to said cleaning member attached to said cleaning member attaching portion at a side opposite to the side at which said exposure opening is provided in the direction transverse to the longitudinal direction of said cleaning frame is 0.5 mm to 3.0 mm.

34 Claims, 16 Drawing Sheets

PROCESS CARTRIDGE WITH CLEANING FRAME HAVING REINFORCING MEMBER

BACKGROUND OF THE INVENTION

1. Field of the Invention

The present invention relates to a cleaning frame, a process cartridge and an electrophotographic image forming apparatus onto which such a process cartridge is detachably mountable.

The electrophotographic image forming apparatus serves to form an image on a recording medium by using an electrophotographic image forming process and may be embodied, for example, as an electrophotographic copying machine, an electrophotographic printer (for example, LED printer, laser beam printer or the like), an electrophotographic facsimile apparatus or an electrophotographic word processor.

On the other hand, the process cartridge may integrally incorporate an electrophotographic photosensitive member and a charging means or a developing means and a cleaning means as a cartridge unit which is detachably mountable to a main body of the electrophotographic image forming apparatus, or may integrally incorporate an electrophotographic photosensitive member and the cleaning means and at least one of the charging means and the developing means as a cartridge unit which is detachably mountable to a main body of the electrophotographic image forming apparatus, or may integrally incorporate an electrophotographic photosensitive member and at least the cleaning means as a cartridge unit which is detachably mountable to a main body of the electrophotographic image forming apparatus.

2. Related Background Art

In the past, since a cleaning frame is disposed in the vicinity of the fixing means by the fact that the cleaning means is followed by the fixing means, due to inherent constructural feature of an image forming apparatus, the cleaning frame might be deformed by heat from the fixing means. Of course, the greater a sheet pass width the greater an amount of thermal deformation.

Conventionally, in an image forming apparatus using an electrophotographic image forming process, a process cartridge obtained by integrally incorporating an electrophotographic photosensitive member and a process means acting on the electrophotographic photosensitive member as a cartridge unit which is detachably mountable to a main body of the electrophotographic image forming apparatus has been used. By using such a process cartridge, since maintenance of the apparatus can be performed by the operator himself without any expert, operability can be improved remarkably. Thus, the process cartridge has widely been used with the image forming apparatus.

The process cartridge is constituted by a cleaning unit integrally including a charging means, a cleaning means and a photosensitive drum, and a developing unit integrally including developing means and toner to be supplied to the developing means. The cleaning unit and the developing unit are interconnected by joining members, thereby forming the process cartridge.

In an image forming apparatus onto which such a process cartridge is detachably mountable, in some cases, in a condition that the process cartridge is mounted, the cleaning unit is opposed to the fixing means.

SUMMARY OF THE INVENTION

An object of the present invention is to provide a cleaning frame which is hard to be thermally deformed in an electrophotographic image forming apparatus in which thermal fixing means is opposed to the cleaning frame for supporting a cleaning means, a process cartridge having such a cleaning frame, and an electrophotographic image forming apparatus onto which such a process cartridge is detachably mountable.

To achieve the above object, according to an embodiment of the present invention, there is provided a cleaning frame used in a process cartridge which is detachably mountable to a main body of an electrophotographic image forming apparatus and which includes an electrophotographic photosensitive drum, and a cleaning member for removing developer adhered to the electrophotographic photosensitive drum, the cleaning frame comprising a drum attaching portion for attaching the electrophotographic photosensitive drum, a cleaning member attaching portion for attaching the cleaning member, one end wall provided at one longitudinal end of the cleaning frame, the other end wall provided at the other longitudinal end of the cleaning frame, an exposure opening for receiving information light to be illuminated onto the electrophotographic photosensitive drum attached to the drum attaching portion when the process cartridge is mounted to the main body of the apparatus, and a reinforcing member provided between the one end wall and the other end wall along the longitudinal direction of the cleaning frame at a side opposite to a side at which the exposure opening is provided in a direction transverse to the longitudinal direction of the cleaning frame.

According to another embodiment of the present invention, there is provided a process cartridge which is detachably mountable to a main body of an electrophotographic image forming apparatus, the process cartridge comprising (a) a cleaning frame including a drum attaching portion for attaching an electrophotographic photosensitive drum, a cleaning member attaching portion for attaching a cleaning member, one end wall provided at one longitudinal end of the cleaning frame, the other end wall provided at the other longitudinal end of the cleaning frame, an exposure opening for receiving information light to be illuminated onto the electrophotographic photosensitive drum attached to the drum attaching portion when the process cartridge is mounted to the main body of the apparatus, and a reinforcing member provided between the one end wall and the other end wall along the longitudinal direction of the cleaning frame at a side opposite to a side at which the exposure opening is provided in a direction transverse to the longitudinal direction of the cleaning frame, (b) the electrophotographic photosensitive drum attached to the drum attaching portion, and (c) the cleaning member attached to the cleaning member attaching portion.

According to a further embodiment of the present invention, there is provided an electrophotographic image forming apparatus onto which a process cartridge is detachably mountable for forming an image on a recording medium, the electrophotographic image forming apparatus comprising (a) a mounting means capable of detachably mounting a process cartridge including a cleaning frame having a drum attaching portion for attaching an electrophotographic photosensitive drum, a cleaning member attaching portion for attaching a cleaning member, one end wall provided at one longitudinal end of the cleaning frame, the other end wall provided at the other longitudinal end of the cleaning frame, an exposure opening for receiving information light to be illuminated onto the electrophotographic photosensitive drum attached to the drum attaching portion when the process cartridge is mounted to the main body of the apparatus, and a reinforcing member provided between the one end wall and the other end wall along the longitudinal direction of the cleaning frame at a side opposite to a side at which the exposure opening is provided in a direction transverse to the longitudinal direction of the cleaning frame; the electrophotographic photosensitive drum attached to the drum attaching portion; and the cleaning member attached to the cleaning member attaching portion, and (b) a conveying means for conveying the recording medium.

According to a still further embodiment of the present invention, there is provided a cleaning frame of a process cartridge detachably mountable to a main body of an electrophotographic image forming apparatus, which cleaning frame supports an electrophotographic photosensitive drum and a cleaning blade for removing developer as waste toner remaining on the electrophotographic photosensitive drum after transferring and has a waste toner chamber, wherein a rib reaching to both end walls of a body of the cleaning frame with respect to a longitudinal direction of the electrophotographic photosensitive drum substantially in parallel with the electrophotographic photosensitive drum and defining a gap between the rib and a wall of the waste toner chamber opposed to the electrophotographic photosensitive drum is provided in the waste toner chamber.

According to a further embodiment of the present invention, there is provided a process cartridge detachably mountable to a main body of an electrophotographic image forming apparatus, the process cartridge comprising an electrophotographic photosensitive drum, a cleaning blade for removing developer as waste toner remaining on the electrophotographic photosensitive drum after transferring, and a cleaning frame supporting the electrophotographic photosensitive drum and the cleaning blade and having a waste toner chamber, wherein a rib reaching to both end walls of a body of the cleaning frame with respect to a longitudinal direction of the electrophotographic photosensitive drum substantially in parallel with the electrophotographic photosensitive drum and defining a gap between the rib and a wall of the waste toner chamber opposed to the electrophotographic photosensitive drum is provided in the waste toner chamber.

According to a still further embodiment of the present invention, there is provided an electrophotographic image forming apparatus onto which a process cartridge is detachably mountable for forming an image on a recording medium, the electrophotographic image forming apparatus comprising (a) a mounting means capable of detachably mounting a process cartridge including an electrophotographic photosensitive drum, a cleaning blade for removing developer as waste toner remaining on the electrophotographic photosensitive drum after transferring, and a cleaning frame supporting the electrophotographic photosensitive drum and the cleaning blade and having a waste toner chamber and wherein a rib reaching to both end walls of a body of the cleaning frame with respect to a longitudinal direction of the electrophotographic photosensitive drum substantially in parallel with the electrophotographic photosensitive drum and defining a gap between the rib and a wall of the waste toner chamber opposed to the electrophotographic photosensitive drum is provided in the waste toner chamber, (b) a thermal fixing means opposed to the cleaning frame at a front side of the process cartridge in a mounting direction at the process cartridge, and (c) a conveying means for conveying the recording medium.

DETAILED DESCRIPTION OF THE PREFERRED EMBODIMENTS

Now, a preferred embodiment of the present invention will be explained. In the following explanation, a "lateral direction" of a process cartridge B is referred to as a mounting and dismounting direction of the process cartridge B to and from a main body 14 of an image forming apparatus, which is aligned with a recording medium conveying direction. Further, a "longitudinal direction" of the process cartridge B is referred to as a direction transverse (substantially perpendicular) to the mounting and dismounting direction of the process cartridge B to and from the main body 14 of the image forming apparatus, which is transverse (substantially perpendicular) to the recording medium conveying direction.

Figure 1:
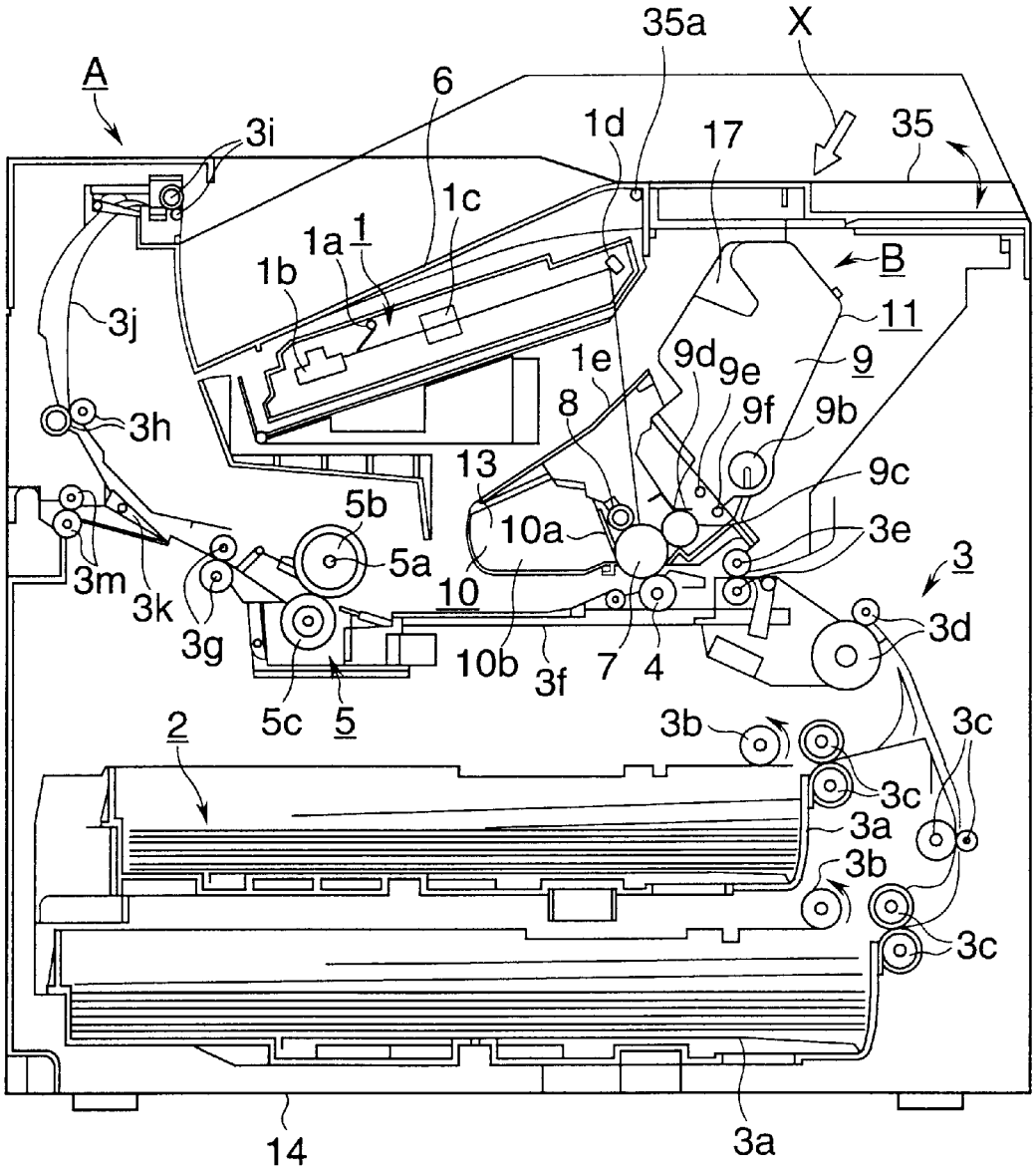
FIG. 1 is a side sectional view of an electrophotographic image forming apparatus to which an embodiment of the present invention is applied.
Figure 2:
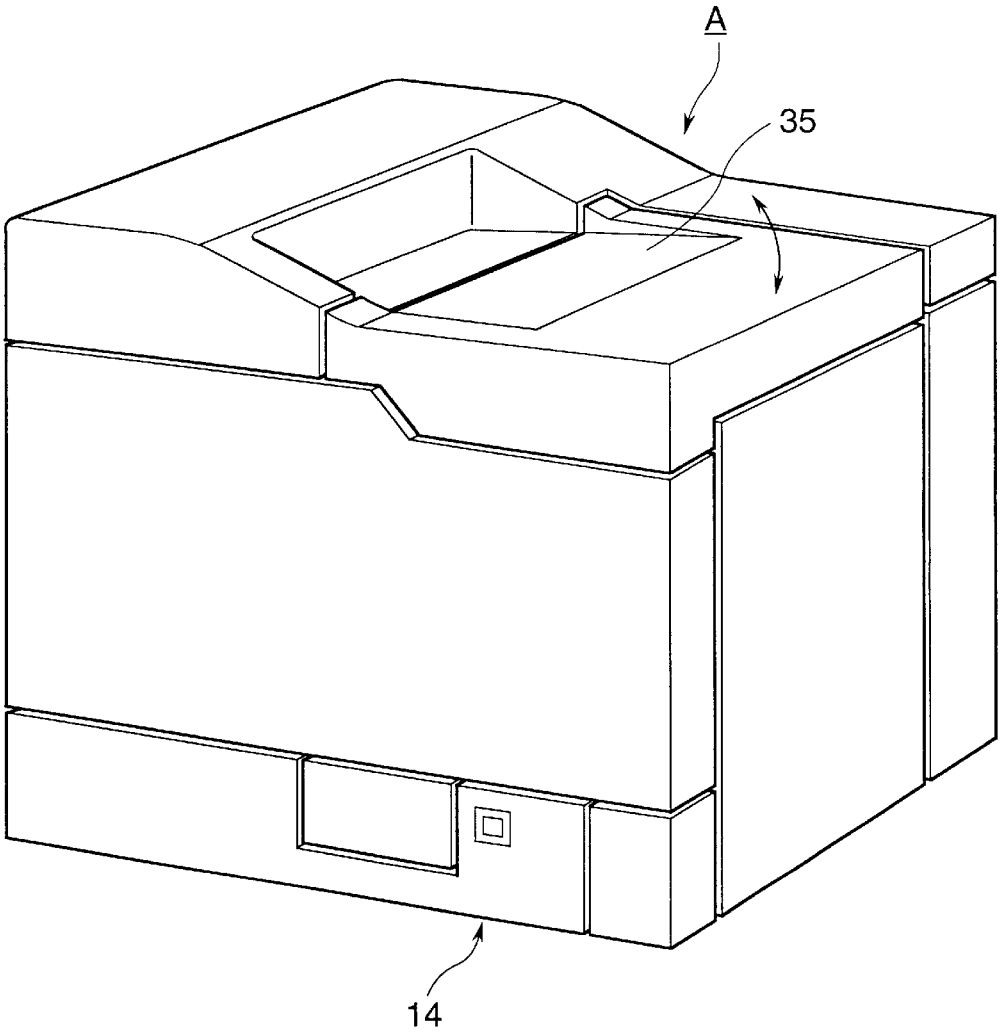
FIG. 2 is a perspective view of the apparatus of FIG. 1.
Figure 3:
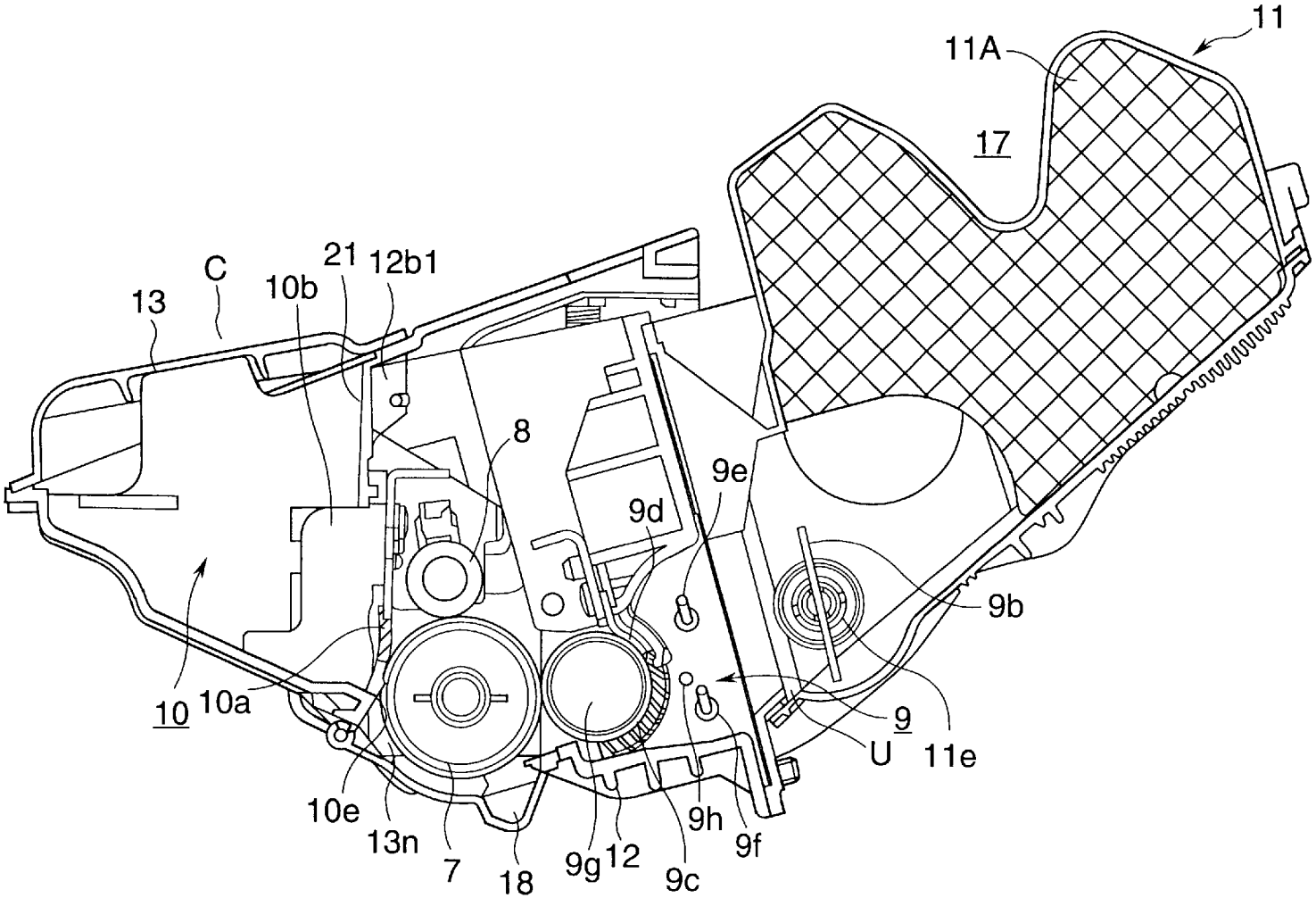
FIG. 3 is a side sectional view of a process cartridge to which an embodiment of the present invention is applied.
Figure 4:
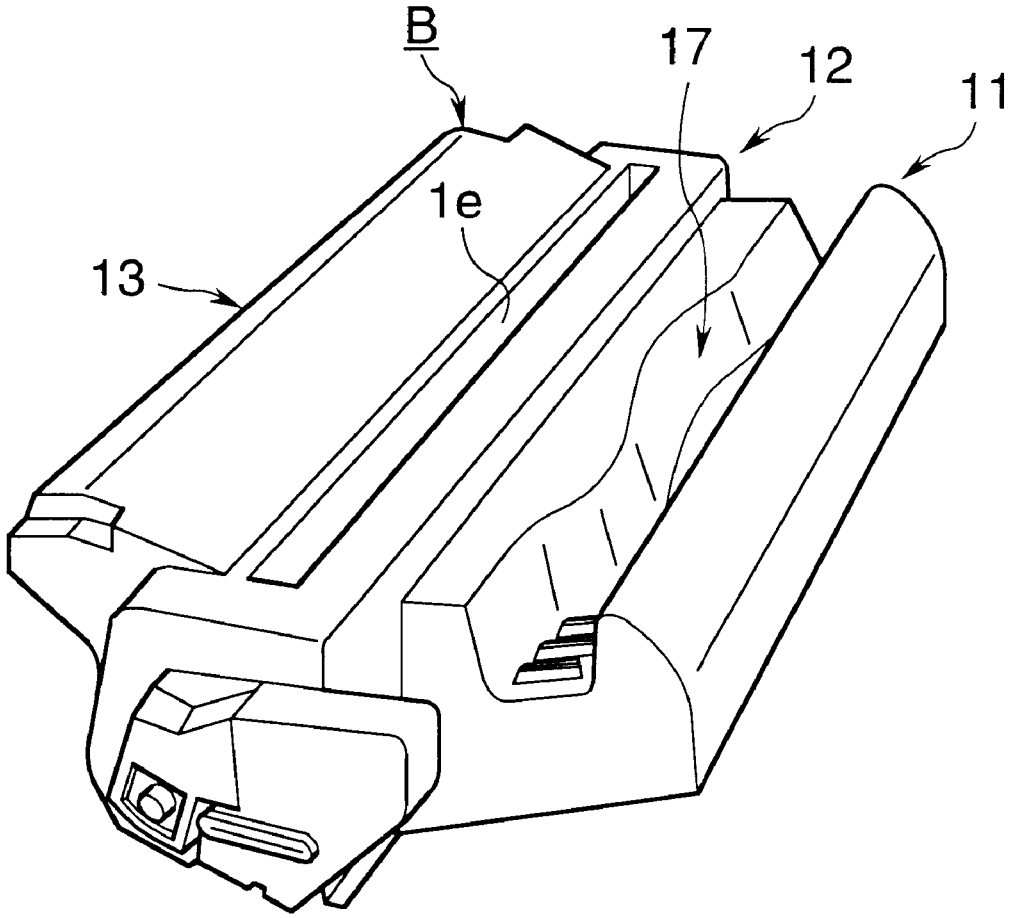
FIG. 4 is a schematic perspective view of the process cartridge of FIG. 3.
Figure 5:
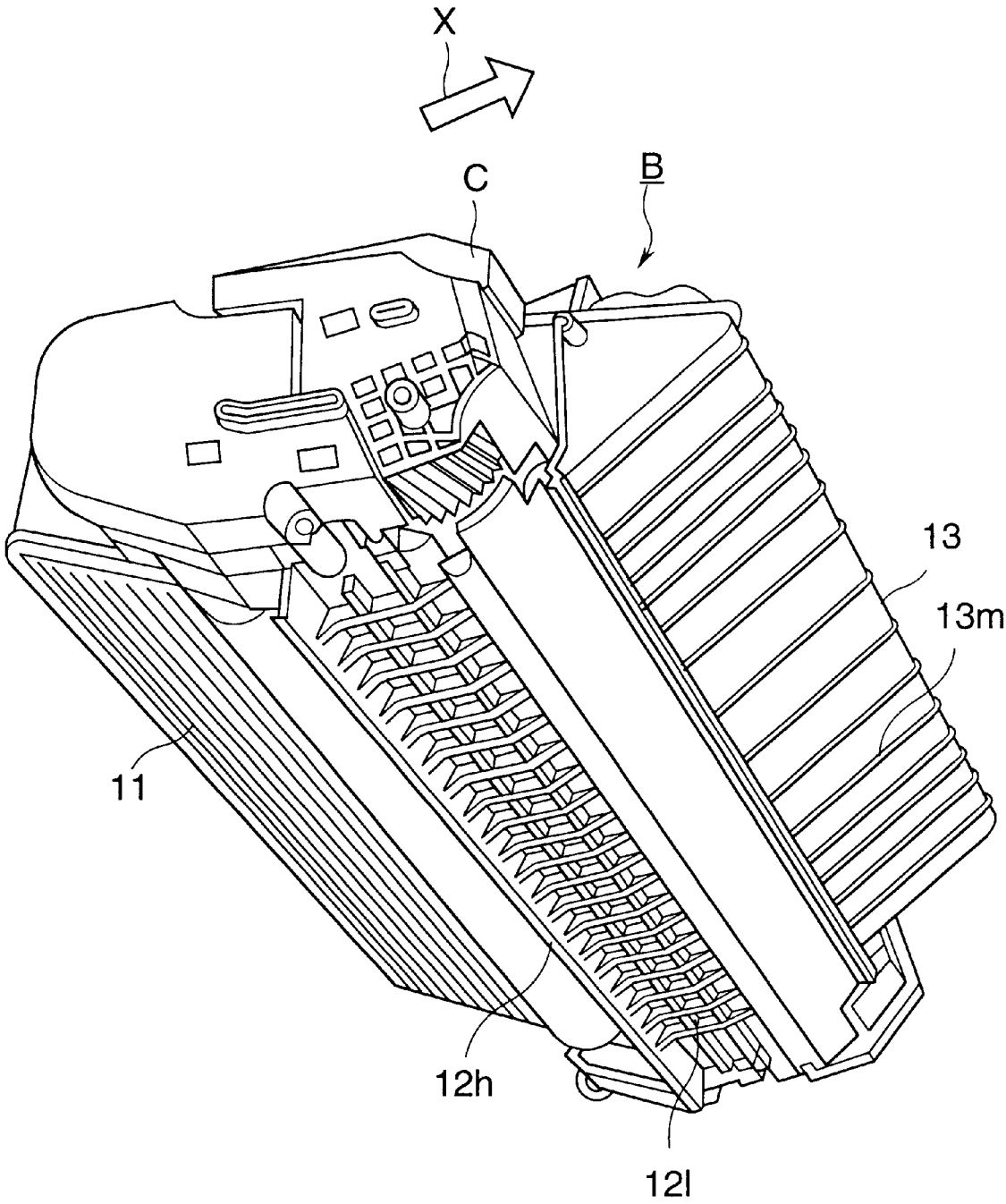
FIG. 5 is a perspective view of the process cartridge of FIG. 3, looked at from below.

FIG. 1 is an explanatory view showing a construction of an electrophotographic image forming apparatus (laser beam printer) to which an embodiment of the present invention is applied, and FIG. 2 is a perspective view of the image forming apparatus. FIGS. 3 to 5 show a process cartridge to which an embodiment of the present invention is applied. FIG. 3 is a side sectional view of the process cartridge, FIG. 4 is a schematic perspective view of the process cartridge, and FIG. 5 is a perspective view of the process cartridge, looked at from below (lower surface). Further, in the following explanation, the "upper surface" of the process cartridge is referred to as a surface located upward when the process cartridge B is mounted to the main body 14 of the image forming apparatus, and the "lower surface" is referred to as a surface located downward at that time.

Electrophotographic Image Forming Apparatus A and Process Cartridge B

First of all, a laser beam printer A as an electrophotographic image forming apparatus to which an embodiment of the present invention is applied will be explained with reference to FIGS. 1 and 2. Further, FIG. 3 is a side sectional view of the process cartridge B.

As shown in FIG. 1, the laser beam printer A serves to form an image on a recording medium (for example, recording paper, OHP sheet, cloth or the like) by using an electrophotographic image forming process. A toner image is formed on a drum-shaped electrophotographic photosensitive member (referred to as "photosensitive drum" hereinafter). More specifically, the photosensitive drum is charged by charging means, and then, a latent image corresponding to image information is formed on the photosensitive drum by illuminating a laser beam corresponding to the image information from optical means onto the photosensitive drum. The latent image is developed by developing means to form a toner image. In synchronism with the toner image formation, a recording medium 2 is conveyed from a cassette 3*a* by a pick-up roller 3*b*, pairs of convey rollers 3*c*, 3*d* and a pair of registration rollers 3*e* while reversing a front surface and a rear surface of the recording medium 2. Then, the toner image formed on the photosensitive drum of the process cartridge B is transferred onto the recording medium 2 by applying a voltage to a transfer roller (transfer means) 4. Thereafter, the recording medium 2 to which the toner image is transferred is conveyed to a fixing means 5 via a convey guide 3*f*. The fixing means 5 includes a driving roller 5*c*, and a fixing roller 5*b* having a heater 5*a* therein. By applying heat and pressure to the recording medium 2 passed through the fixing means, the transferred toner image is fixed to the recording medium. Then, the recording medium 2 is conveyed by pairs of discharge rollers 3*g*, 3*h*, 3*i* and is discharged onto a discharge tray 6 through a surface reverse path 3*j*. The discharge tray 6 is provided on an upper surface of the main body 14 of the image forming apparatus A. Incidentally, by operating a pivotally movable flapper 3*k*, the recording medium 2 can be discharged by a pair of discharge rollers 3*m* without passing through the surface reverse path 3*j*. In the illustrated embodiment, the pick-up roller 3*b*, the pairs of convey rollers 3*c*, 3*d*, the pair of registration rollers 3*e*, the convey guide 3*f*, the pairs of discharge rollers 3*g*, 3*h*, 3*i* and pair of discharge rollers 3*m* constitute conveying means 3.

On the other hand, as shown in FIGS. 3 to 5, in the process cartridge B, the photosensitive drum 7 having a photosensitive layer is rotated, and a surface of the drum is uniformly charged by applying a voltage to a charging roller (charging means) 8. Then, by illuminating the laser beam corresponding to the image information from an optical system 1 onto the photosensitive drum 7 through an exposure opening portion 1*e*, the latent image is formed. The latent image is developed by a developing means 9. That is to say, the charging roller 8 is contacted with the photosensitive drum 7 and serves to charge the photosensitive drum 7. The charging roller 8 is rotatingly driven by rotation of the photosensitive drum 7. The developing means 9 serves to develop the latent image formed on the photosensitive drum 7 by supplying toner to a developing area on the photosensitive drum 7. The optical system 1 includes a laser diode 1*a*, a polygon mirror 1*b*, a lens 1*c* and a reflection mirror 1*d*.

In the developing means 9, toner in a toner container 11A is fed out to a developing roller 9*c* by rotation of a toner feeding member 9*b*. While the developing roller 9*c* including a stationary magnet therein is being rotated, a toner layer is formed on the surface of the developing roller 9*c* by a developing blade 9*d* while applying a triboelectrification charge to the toner layer, and the toner (layer) is supplied to the developing area on the photosensitive drum 7. By transferring the toner onto the photosensitive drum 7 in accordance with the latent image, a toner image as a visualized image is formed. The developing blade 9*d* serves to regulate an amount of toner on the peripheral surface of the developing roller 9*c*. In the vicinity of the developing roller 9*c*, toner agitating members 9*e*, 9*f* for circulating the toner within a developing chamber are rotatably supported.

After the toner image formed on the photosensitive drum 7 is transferred onto the recording medium 2 by applying voltage having polarity opposite to that of the toner image to the transfer roller 4, residual toner remaining on the photosensitive drum 7 is removed by a cleaning means 10. In the cleaning means 10, the toner remaining on the photosensitive drum 7 is scraped off by an elastic cleaning blade 10*a* urged against the photosensitive drum 7, and the scraped-off toner is collected into a waste toner reservoir 10*b*.

Incidentally, the process cartridge B is obtained by joining a toner frame 11 having a toner container (toner containing portion) 11A for containing the toner to a developing frame 12 for holding the developing means 9 such as a developing roller 9*c* to form an assembly and by joining a cleaning frame 13 to which the photosensitive drum 7, the cleaning means 10 such as the cleaning blade 10*a* and the charging roller 8 are attached to the assembly. The process cartridge B is detachably mountable to the main body 14 of the apparatus by the operator.

The exposure opening portion 1*e* through which the light corresponding to the image information is illuminated onto the photosensitive drum 7 and a transfer opening portion 13*n* through which the recording medium 2 is opposed to the photosensitive drum 7 are formed in the process cartridge B. More specifically, the exposure opening portion 1*e* is formed in the cleaning frame 13, and the transfer opening portion 13*n* is defined between the developing frame 12 and the cleaning frame 13.

Next, a construction of the housing of the process cartridge B according to the illustrated embodiment will be explained.

In the process cartridge B according to the illustrated embodiment, the photosensitive drum 7, the charging roller 8, the developing means 9 and the cleaning means 10 are housed in the housing obtained by joining the toner frame 11 to the developing frame to form the assembly and by further rotatably joining the cleaning frame 13 to the assembly. The process cartridge B is detachably mountable to cartridge mounting means provided in the main body 14 of the apparatus.

Construction of Housing of Process Cartridge B

As mentioned above, in the process cartridge B according to the illustrated embodiment, the housing is constituted by joining the toner frame 11, the developing frame 12 and the cleaning frame 13. Now, the construction of the housing will be explained.

As shown FIG. 3, a toner feeding member 9*b* is rotatably attached to the toner frame 11. Further, the developing roller 9*c* and the developing blade 9*d* are attached to the developing frame 12, and the toner agitating members 9*e*, 9*f* for circulating the toner in the developing chamber are rotatably attached in the vicinity of the developing roller 9*c*. An antenna rod 9*h* is attached substantially in parallel with the developing roller 9*c* along the longitudinal direction of the developing roller 9*c*. The toner frame 11 is welded (by ultrasonic welding in the illustrated embodiment) to the developing frame 12 to form a unitary developing unit (second frame) D.

Further, the photosensitive drum 7, the charging roller 8 and the cleaning means 10 are attached to the cleaning frame 13. A drum shutter member 18 for covering the photosensitive drum 7 to protect the drum from being exposed to the light for a long term and from being contacted with foreign matter when the process cartridge B is dismounted from the main body 14 of the apparatus is further attached to the cleaning frame 13 to form a cleaning unit (first frame) C.

Construction of Cleaning Unit

Figure 6:
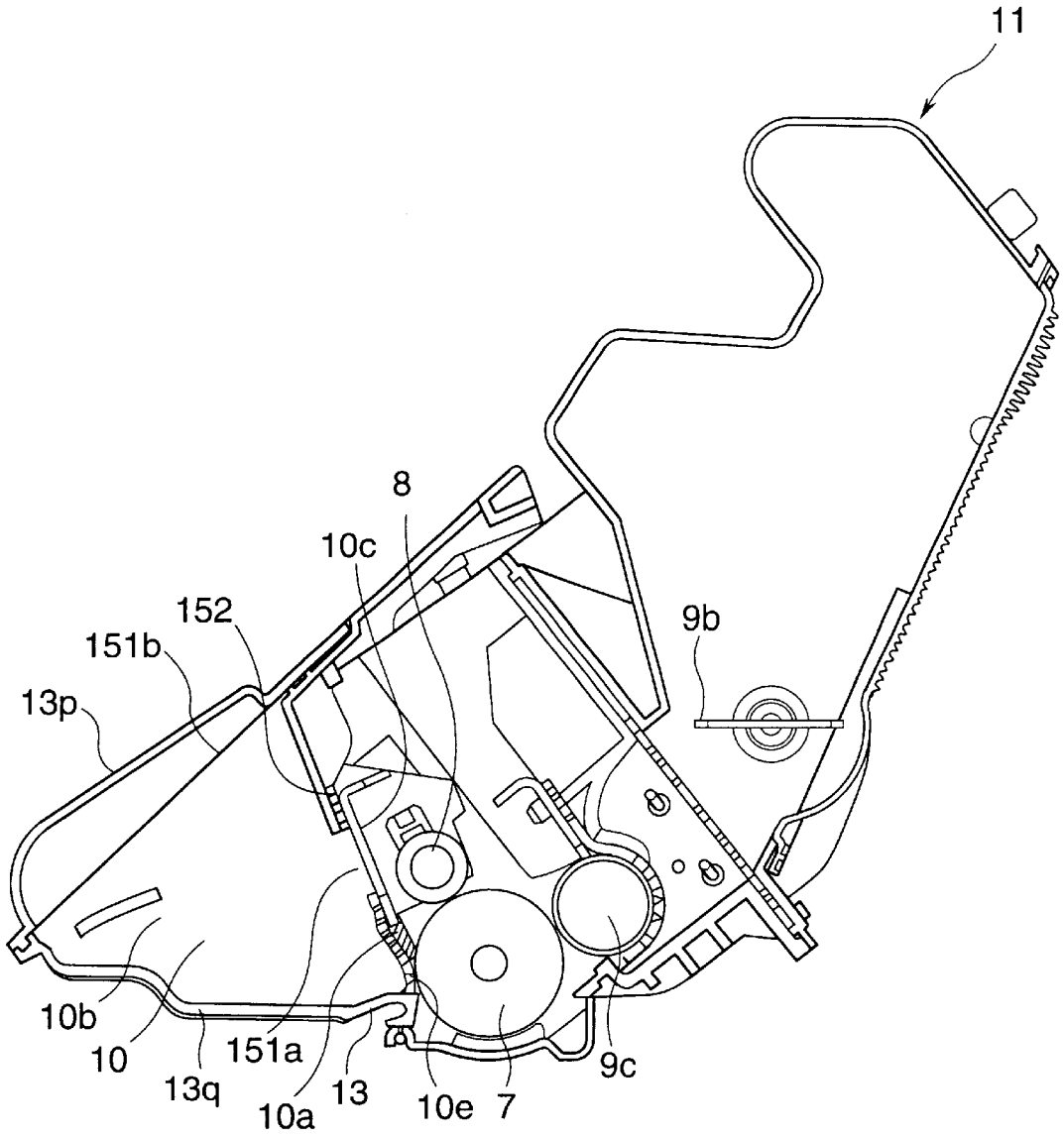
FIG. 6 is a side sectional view of a process cartridge to which an embodiment of the present invention is applied.

Now, the cleaning means 10 will be described with reference to FIG. 6. The frame 13 for the cleaning means 10 is constituted by a cleaning frame body 13*q* and a lid 13*p*. The photosensitive drum 7, the cleaning blade 10*a*, a dip sheet 10*e* and the charging roller (charging means) 8 are integrally incorporated into the single cleaning frame body 13*q*. Further, the waste toner reservoir 10*b* is provided in the cleaning frame body 13*q*, and the waste toner reservoir 10*b* is covered by a cleaning blade metal plate 10*c*. A dimension of an opening portion 151*a* of the cleaning frame body 13*q* covered by the cleaning blade metal plate 10*c* is made small so that such an opening portion can be covered by the cleaning blade metal plate 10*c* having a small width in the lateral direction.

Figure 7:
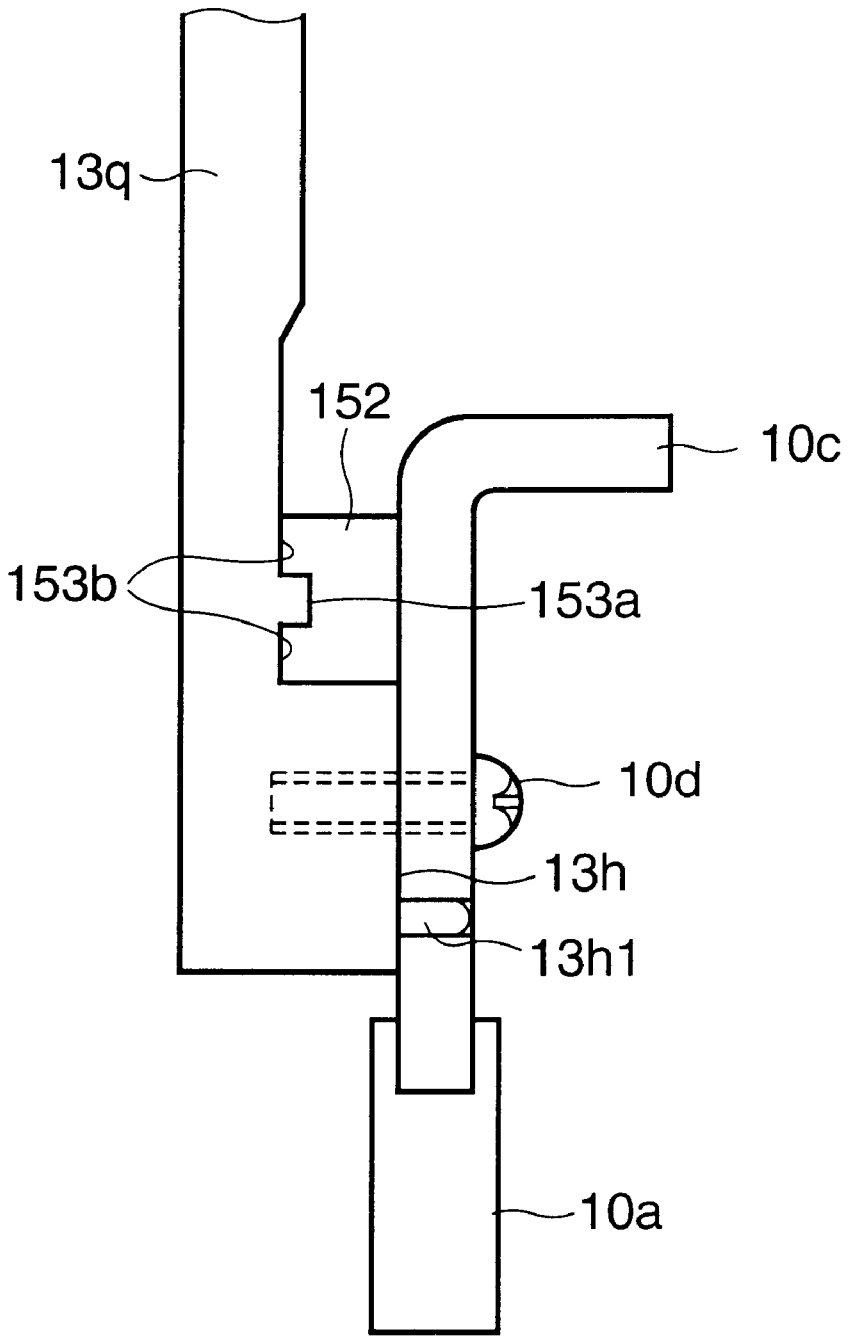
FIG. 7 is a vertical sectional view showing a seal arrangement between a cleaning blade and a cleaning frame.

Further, as shown in FIG. 7, a strip-shaped seal member 152 is provided for a toner seal between the cleaning blade metal plate 10*c* and the cleaning frame body 13*q*. The seal member 152 is adhered to a seal adhering rib 153*a* of the cleaning frame body 13*q*. Since the seal member 152 is also adhered to sunken surfaces 153*b* on both sides of the seal adhering rib 153*a*, good sealing ability can be achieved. The seal member 152 extends over a substantially entire longitudinal length of the cleaning blade metal plate 10*c*. Further, between the dip sheet 10*e* and both longitudinal ends of the cleaning blade metal plate 10*c*, spaces between the photosensitive drum 7 and the cleaning frame body 13*q* are sealed by sealing materials (not shown) in the lateral direction, thereby sealing the waste toner reservoir 10*b*.

The cleaning blade metal plate 10*c* abuts against seat portions 13*h* of the cleaning frame body 13*q* provided in correspondence to both longitudinal ends thereof. After the metal plate 10*c* is inserted, by screwing small screws 10*d* into the seat portions 13*h*, both ends of the metal plate 10*c* are secured to the cleaning frame body 13*q*. As a result, a distance between the metal plate 10*c* and the rib (longitudinal ridge) 153*a* is determined, and thus, compression margin of the seal member 152 having a rectangular cross-section, and having a thickness greater than such a distance is determined. For example, the seal member 152 is made of foam urethane rubber. Incidentally, the seat members 13*h* are provided with positioning dowels 13*h*1 by which the position of the cleaning blade metal plate 10*c* is determined.

Figure 8:
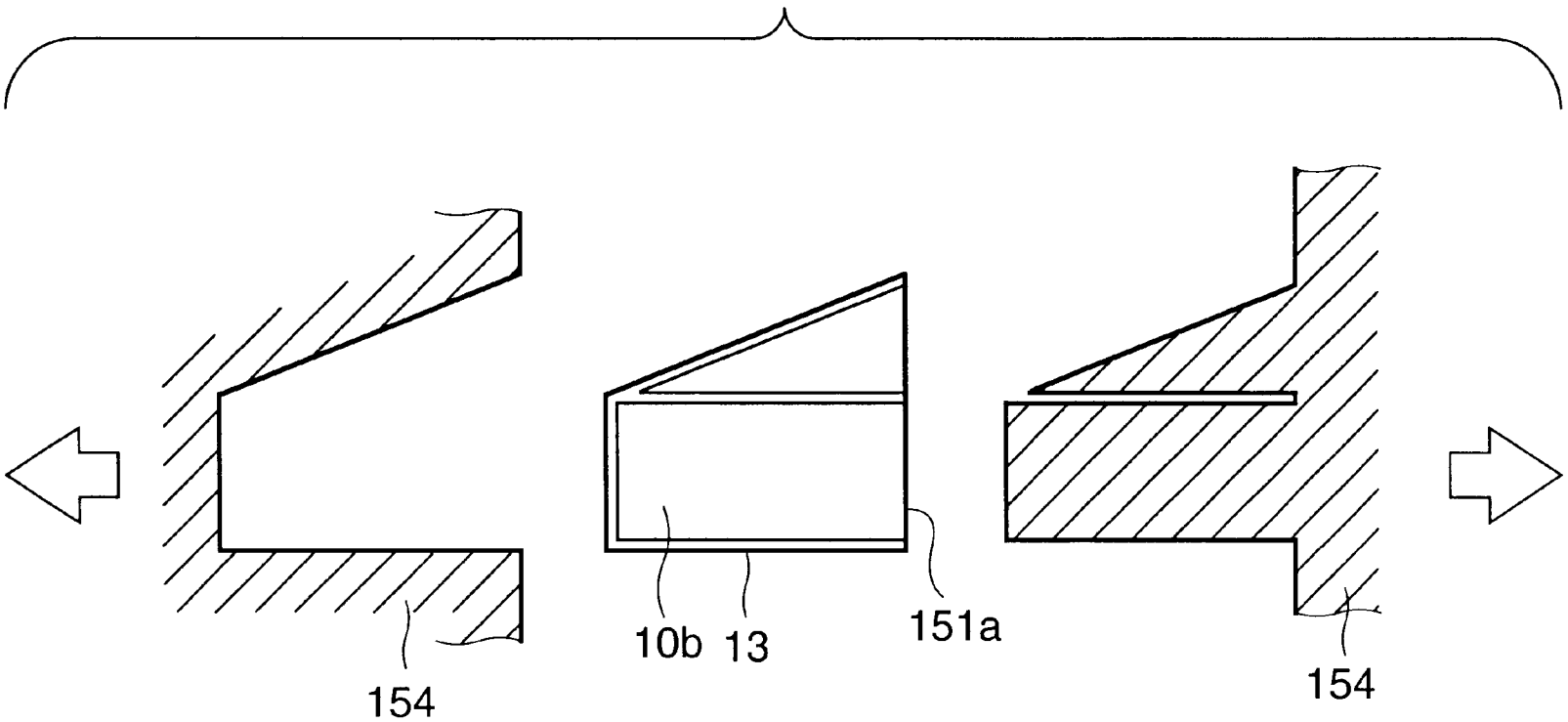
FIG. 8 is an explanatory view showing a mold for molding a conventional cleaning frame.
Figure 9:
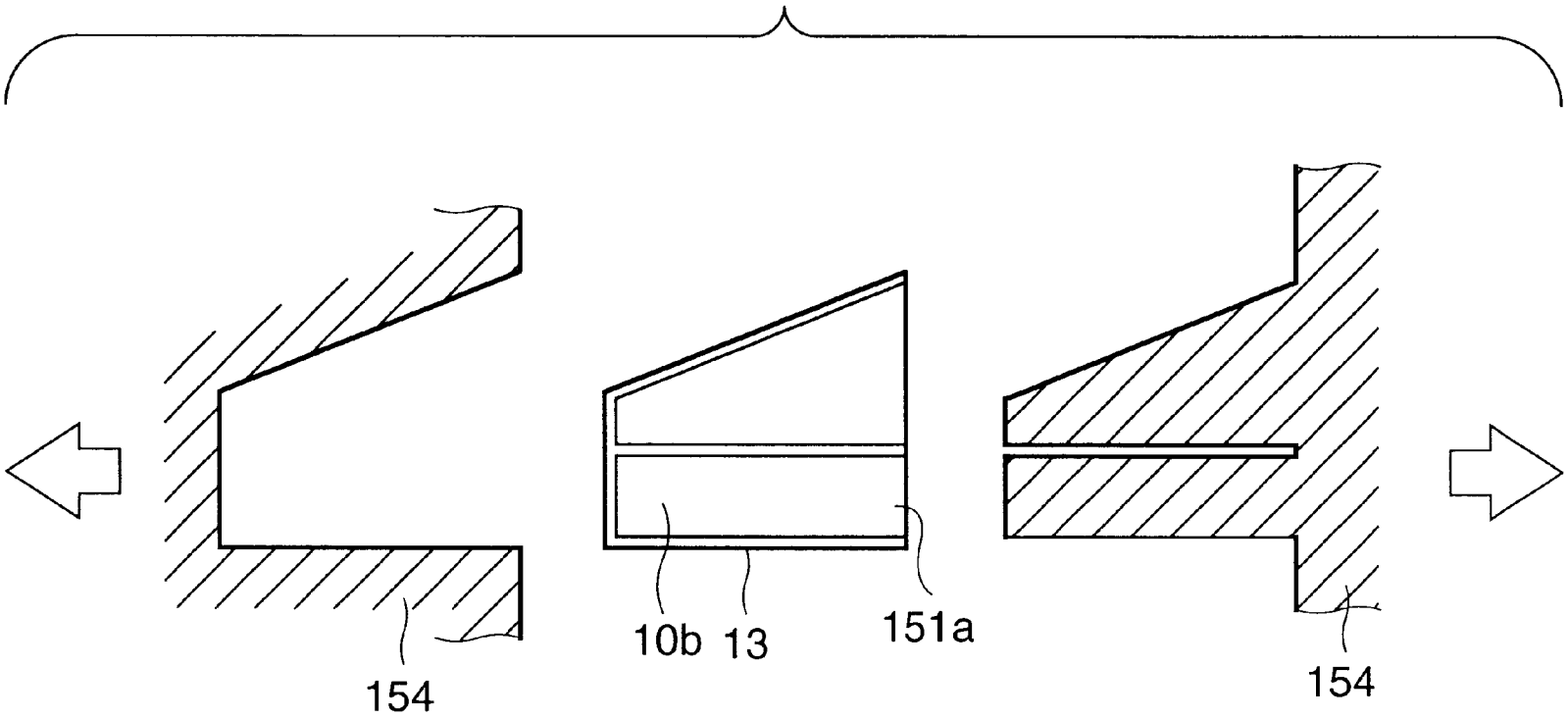
FIG. 9 is an explanatory view showing a mold for molding a conventional cleaning frame.
Figure 10:
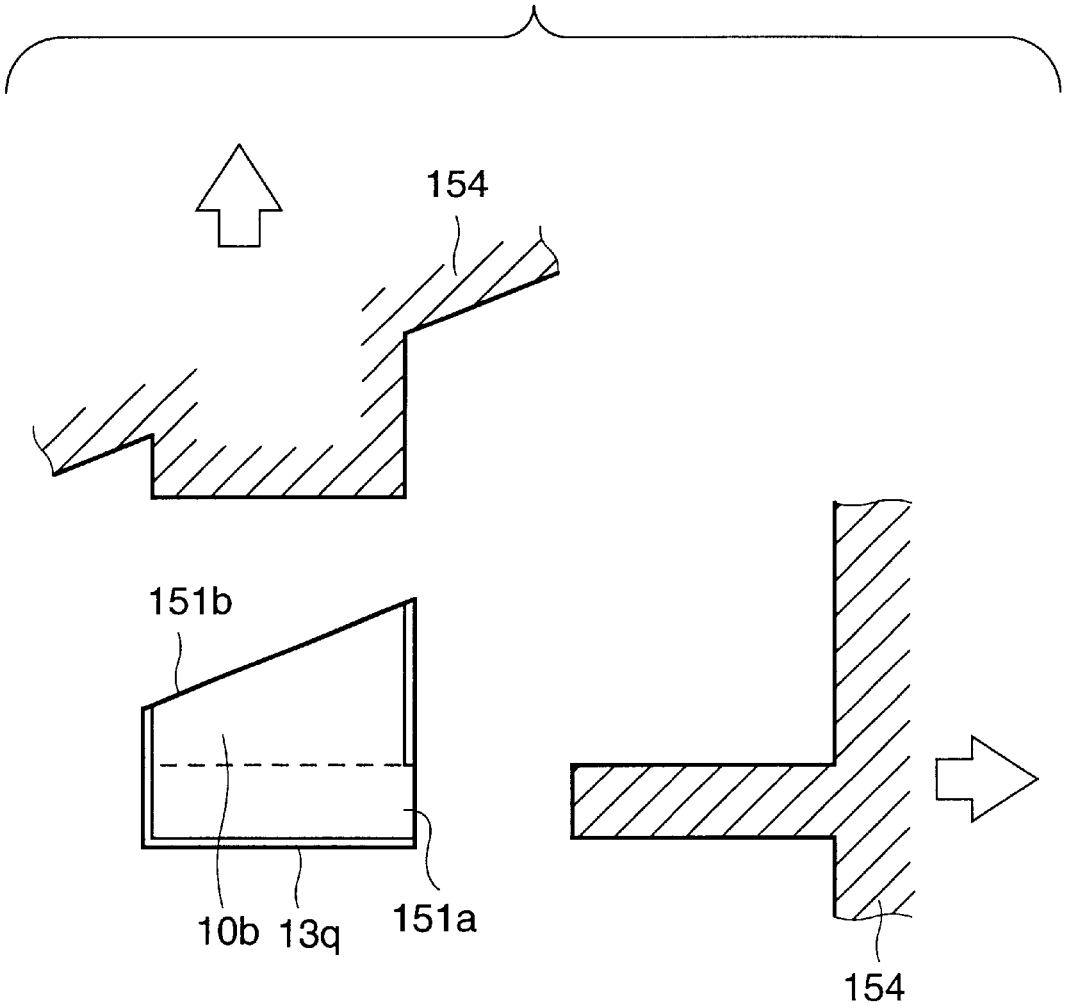
FIG. 10 is an explanatory view showing a mold for molding a cleaning frame according to the present invention, in an embodiment of the present invention.

Since the cleaning frame 13 is formed from resin, the conventional molds 154 for a single frame generally comprises a male mold part and a female mold part, respectively, as shown in FIG. 8. When the opening portion 151*a* is made smaller, as shown in FIG. 9, the waste toner reservoir 10*b* is also made smaller due to inherent structure of the mold 154. In consideration of the structural feature of the mold, in order to maintain a large waste toner reservoir 10*b*, as shown in FIG. 10, it is required for providing an opening portion 151*b* transverse to the opening portion 151*a*. In this case, the opening portion 151*b* is covered or closed by the lid 13*p* of the cleaning frame. The cleaning frame body 13*q* and the cleaning frame lid 13*p* are joined together by vibrating welding, ultrasonic welding, adhesive or screws to prevent toner leakage. Further, in a state that the cleaning frame body 13*q* and the cleaning frame lid 13*p* are joined together, since the entire cleaning frame has a box shape, a rigidity of the cleaning frame 13 is enhanced, thereby suppressing vibration which affects a bad influence upon image formation.

Figure 11:
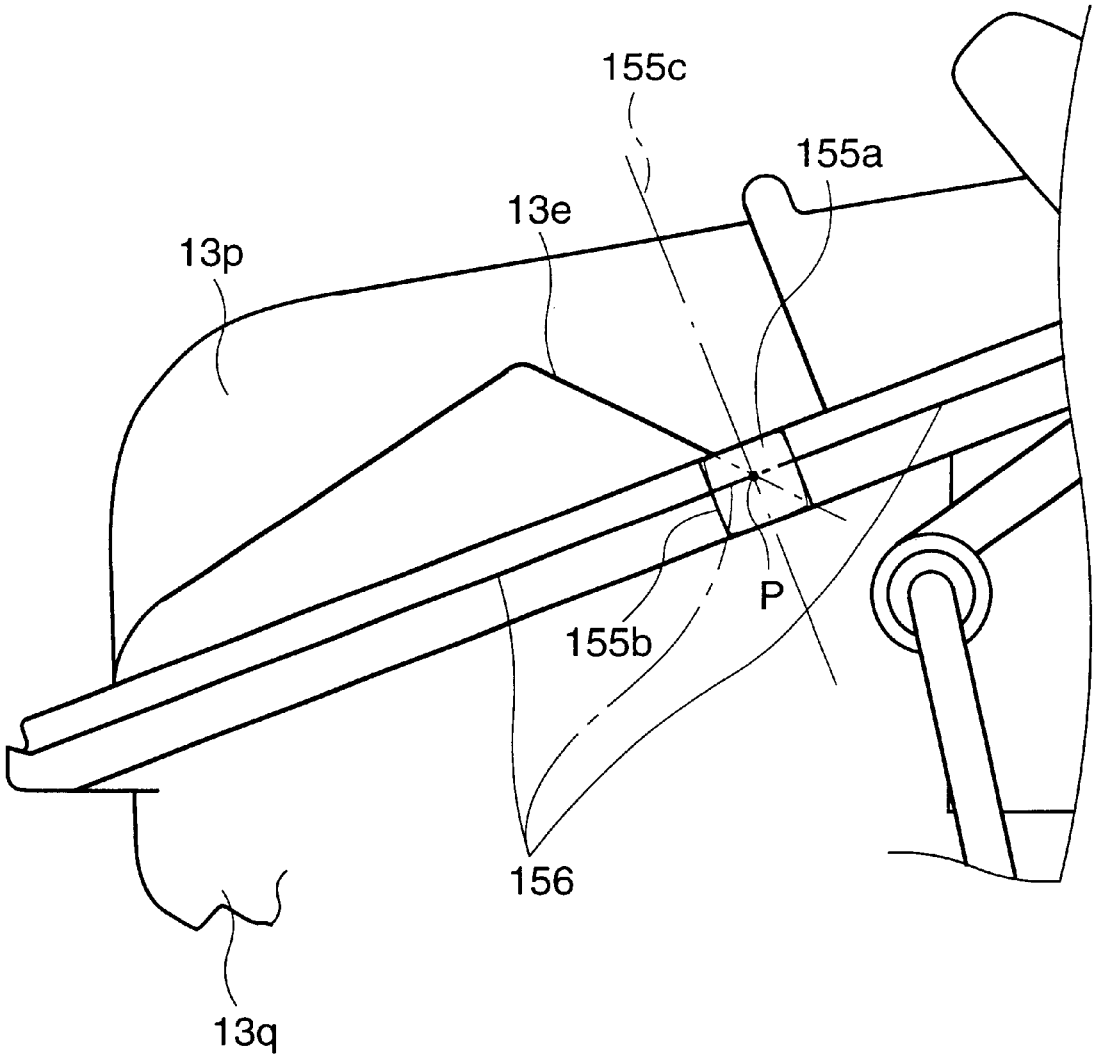
FIG. 11 is a side view showing a welding positioning portion and a positioning portion of a cleaning frame (with respect to a main body of an image forming apparatus) according to an embodiment of the present invention.

Further, as shown in FIG. 11, the cleaning frame lid 13*p* is provided with a regulating abutment portion 13*e* for positioning the process cartridge B with respect to the main body 14 of the apparatus. In order to align the cleaning frame lid 13*p* with the cleaning frame body 13*q*, lateral edges on both longitudinal ends of the cleaning frame lid 13*p* are respectively provided with positioning portions (downwardly directing projections) 155*a*, which positioning portions 155*a* are fitted into cut-away portions 155*b* formed in edges on both longitudinal ends of the cleaning frame body 13*q*.

With this arrangement, the cleaning frame lid 13*p* can be positioned with respect to the cleaning frame body 13*q* by a center 155*c* defined by a straight line perpendicular to a welding surface 156 (interface between the cleaning frame lid 13*p* and the cleaning frame body 13*q*) and passing through a position bisecting each positioning portion 155*a* in the lateral direction. In this arrangement, it is selected so that extension of the regulating abutment portion 13*e* of the cleaning frame lid 13*p*, the center 155*c* of the positioning portion 155*a* of the cleaning frame lid 13*p*, the welding surface 156 pass through the same point P, as shown in FIG. 11. Since the positioning relationships pass through the same point P, after the cleaning frame lid 13*p* and the cleaning frame body 13*q* are welded together, positioning accuracy of the process cartridge B with respect to the main body 14 of the image forming apparatus is enhanced.

Figure 12:
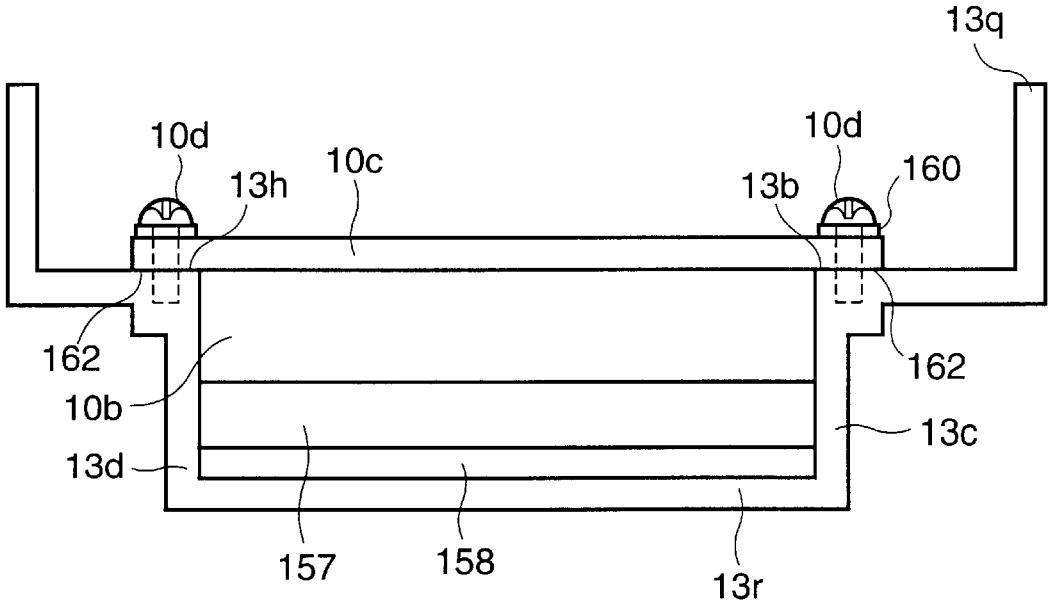
FIG. 12 is a horizontal sectional view of a cleaning frame according to an embodiment of the present invention.
Figure 13:
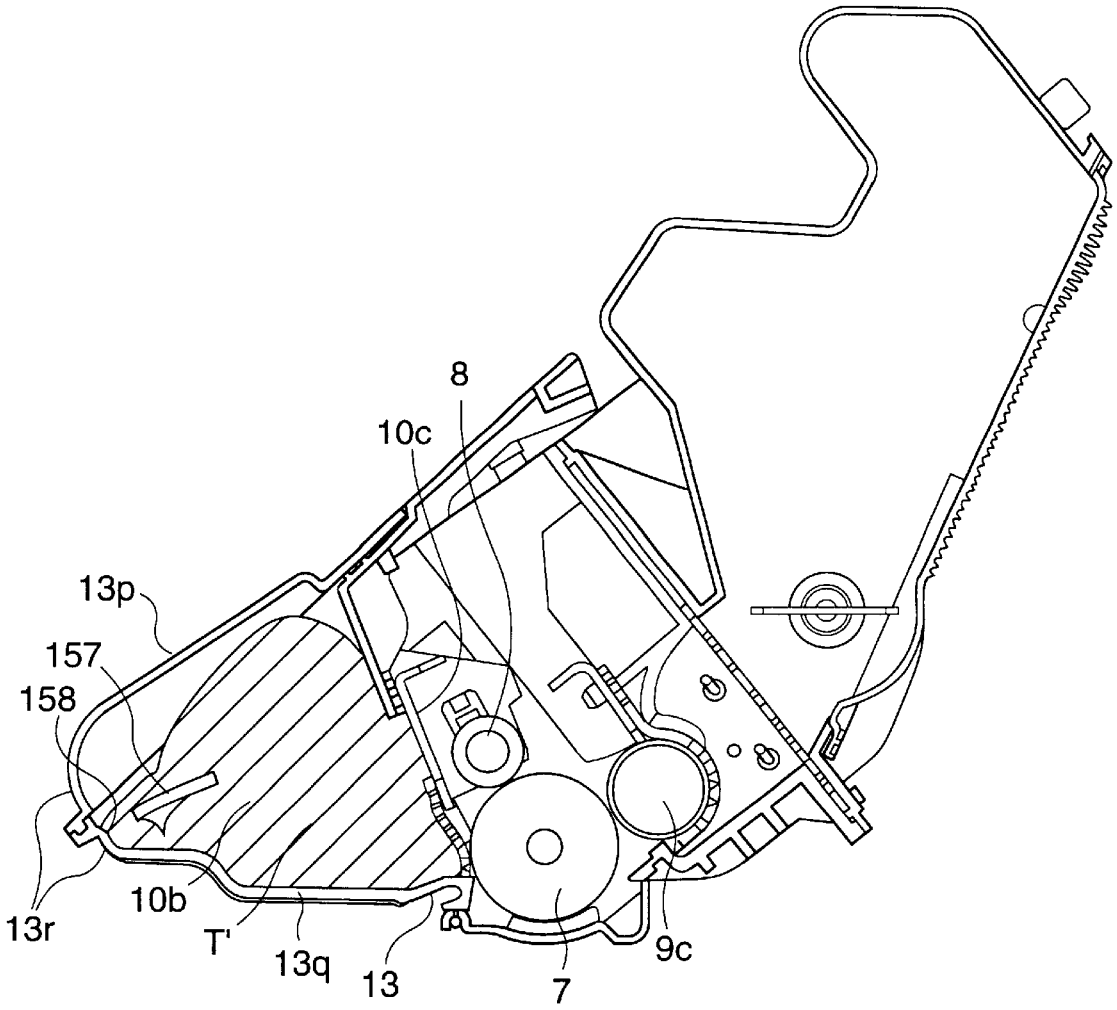
FIG. 13 is a vertical sectional view showing a state that waste toner is accumulated in a cleaning frame according to an embodiment of the present invention.
Figure 14:
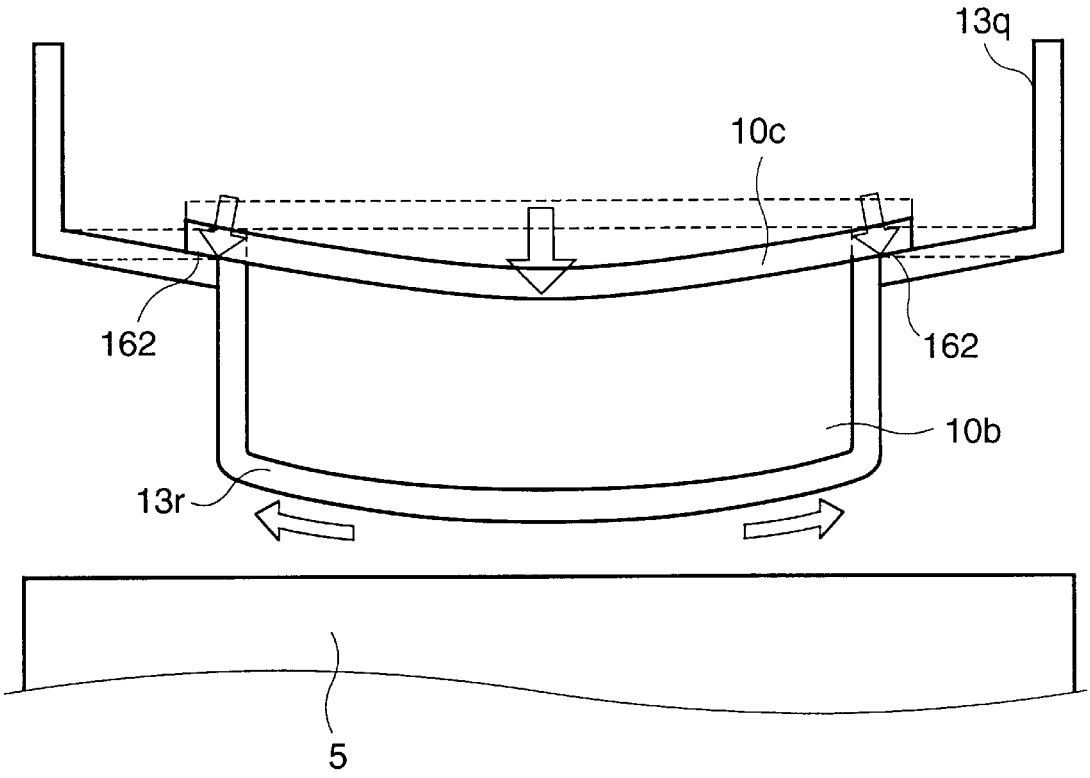
FIG. 14 is a schematic horizontal sectional view showing a state that a conventional cleaning frame and a cleaning blade are deformed and expanded by hear from a fixing device.

Further, as shown in FIG. 12, a rib 157 is provided in the cleaning frame body 13*q* along its entire longitudinal length as a reinforcing member for the cleaning frame. The rib 157 extends along the entire longitudinal length and is spaced apart from a front end (deep side) wall 13*r* of the cleaning frame body 13*q* by 0.5 to 15 mm. The distance between the wall 13*r* and the rib 157 is preferably 0.5 to 3.0 mm. By providing such a distance (gap) 158, transfer of heat from the wall is prevented, and, as shown in FIG. 13, if the waste toner T' is accumulated, the waste toner T' can drop toward the deep side through this gap 158. The rib 157 has a thickness of 1 to 4 mm and a width of 5 to 40 mm. As shown in FIG. 14, if there is no rib 157, when the wall 13*r* of the cleaning frame 13 near the fixing means 5 (heat source) is heated to try to be abruptly expanded, due to difference in thermal expansion between the abruptly heated portion and non-heated portion, deformation of the cleaning frame 13, and, particularly, deformation of attachment portions 162 for the cleaning blade 10*a* (important for cleaning) will occur. By providing the rib 157, such deformation can be suppressed, thereby providing a cleaning frame having great resistance against thermal deformation.

Figure 15:
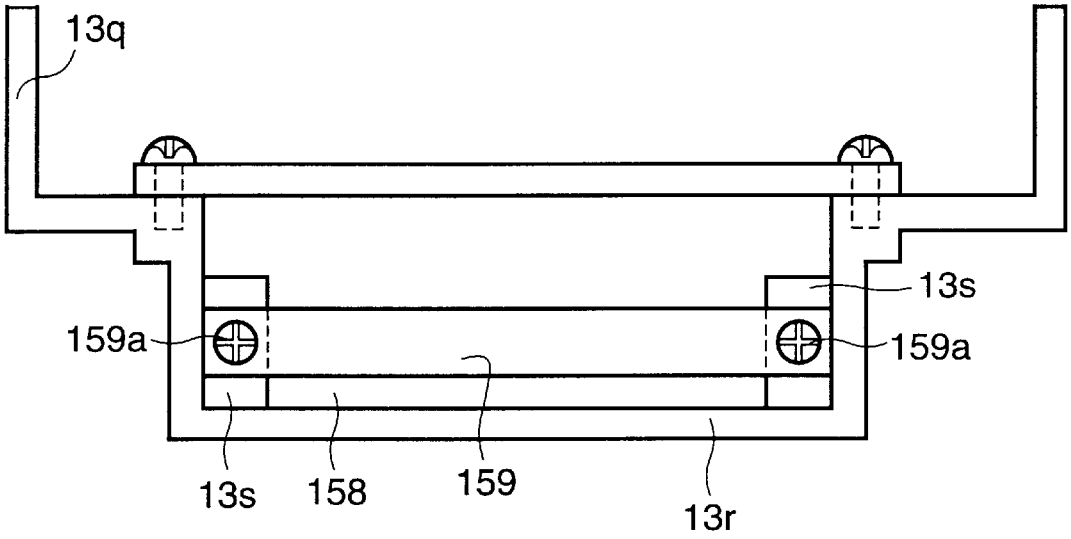
FIG. 15 is a horizontal sectional view of a cleaning frame according to another embodiment of the present invention.

As another embodiment improving the above-mentioned arrangement, as shown in FIG. 15, in place of the rib, a metal plate 159 may be used so that the metal plate is secured to both ends 13*s* in the cleaning frame body 13*q* by small screws 159*a*.

Further, since there is difference in coefficient of thermal expansion between the cleaning frame 13 made of resin and the cleaning blade metal plate 10*c* made of metal, as shown in FIG. 12, in order to permit slight sliding movement between the cleaning frame 13 and the cleaning blade metal plate 10*c* when the cleaning unit is heated, the cleaning blade 10*a* is secured by small screws 10*d* via resin washers 160. Incidentally, the washers 160 may be made of nylon.

Figure 16:
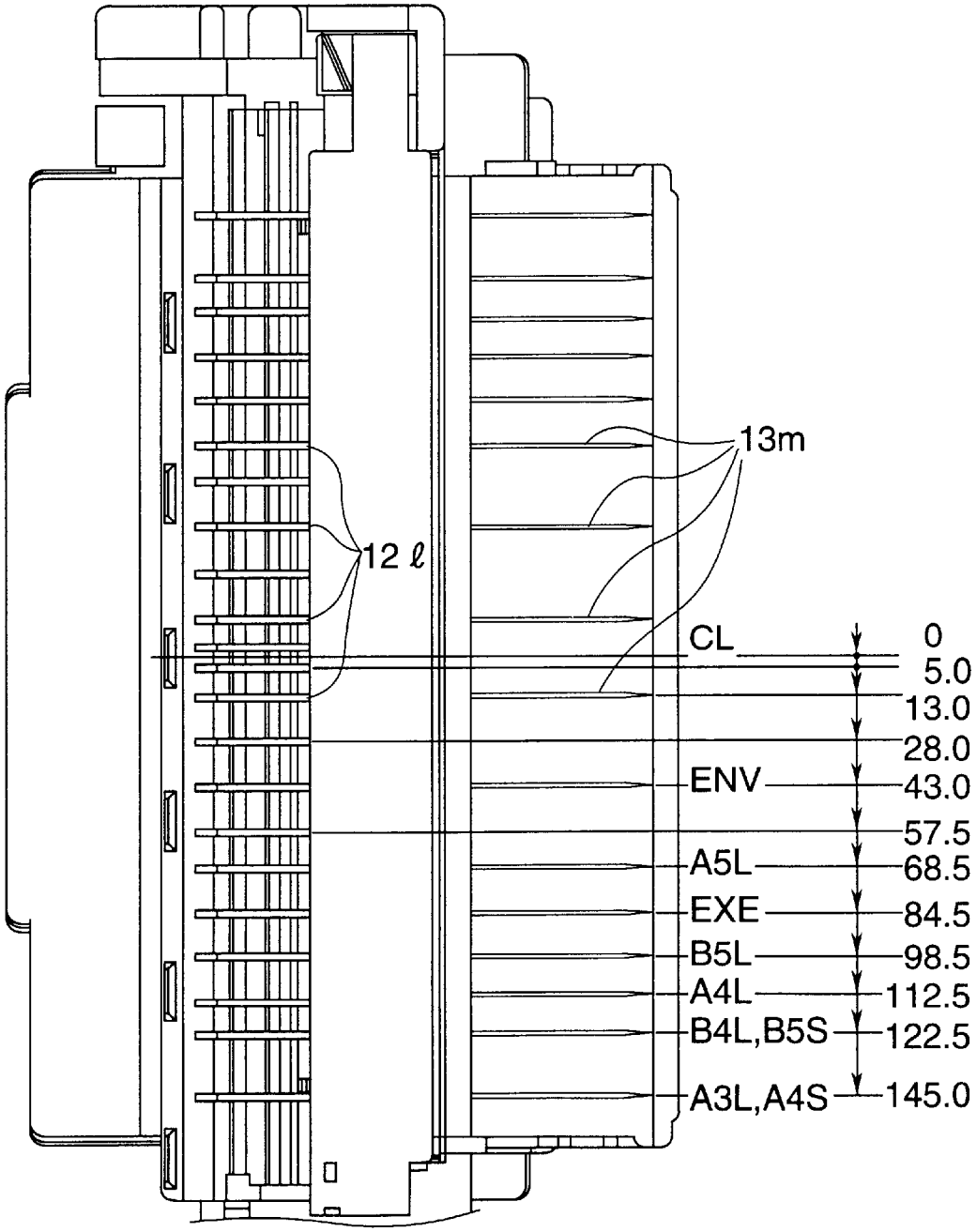
FIG. 16 is a bottom view of a process cartridge.

As shown in FIGS. 5 and 16, the developing frame 12 is provided at its lower surface with the guide ribs 129 and the cleaning frame 13 is provided at its lower surface with the guide ribs 13*m*, which ribs 129, 13*m* are constituted by ridges extending along the moving direction of the recording medium 2. The guide ribs 12*t*, 13*m* are situated slightly inside (about 5 mm in the illustrated embodiment) of both longitudinal ends of the recording medium 2. Additional guide ribs for aiding the conveyance of the recording medium are provided at other positions. The electrophotographic image forming apparatus A according to the illustrated embodiment can form images on recording media 2 having various sizes and can convey any recording medium 2 to pass the recording medium through a central portion of the image forming apparatus (center line CL of the apparatus coincides with the center of the recording medium 2). To this end, in the illustrated embodiment, the developing frame 12 and the cleaning frame 13 are provided at their lower surfaces with plural ribs which are symmetrical with respect to a center line CL. Heights of ribs in the developing frame 12 are predetermined and heights of ribs in the cleaning frame 13 are also predetermined to convey the recording medium advantageously. With this arrangement, a non-fixed toner image is prevented from being contacted with the lower surface of the cleaning frame 13 to prevent distortion of the image, while improving the conveyance of the recording medium.

FIG. 16 shows various dimensions from the center line CL as numerical values (unit: mm), as an example of the illustrated embodiment (only one side). Symbols of standard papers (Japanese Industrial Standards) of the recording medium 2 corresponding to the respective numeral values are indicated. For example, A3L indicates a case where a longitudinal direction of a recording medium having A3 size becomes a conveying direction, and A4S indicates a case where a lateral direction of a recording medium having A4 size becomes a conveying direction. Further, ENV corresponds to a recording medium 2 having an envelope size and EXE corresponds to a recording medium 2 having e ecutive size. Incidentally, the guide ribs 12*l* or(and) 13*m* disposed at distances of 5.0 mm, 13.0 mm and 28.0 mm from the center line CL support a central area of the recording medium 2.

Incidentally, unlike the aforementioned embodiment, in this embodiment, the guide ribs 13*m* have heights gradually increasing toward outside, and the each pair of ribs 13*m* corresponding to each recording medium have the same height. With this arrangement, the inner ribs can surely be prevented from contacting with the imaged surface of the recording medium, thereby avoiding the distortion of the image positively. Also in this case, the disposition of the ribs in the same as the case where the ribs have the same height.

According to the present invention, the cleaning frame has the reinforcing member provided in the waste toner chamber and reaching to both end walls of the body of the cleaning frame with respect to the longitudinal direction of the electrophotographic photosensitive drum substantially in parallel with the electrophotographic photosensitive drum and defining the gap between the reinforcing member and the wall of the waste toner chamber opposed to the electrophotographic photosensitive drum. With this arrangement, if the wall of the waste toner chamber opposed to the electrophotographic photosensitive drum is heated and expanded by the heat from the thermal fixing device, since both end walls of the cleaning frame (with respect to the longitudinal direction of the electrophotographic photosensitive drum) are interconnected by the reinforcing member through which the heat from the thermal fixing device is difficult to be transferred, deformation of both end walls of the cleaning frame is suppressed.

When the reinforcing member is molded-integrally with the cleaning frame, the number of assembling steps and the assembling time are not increased.

When the reinforcing member is made of metal, rigidity of the cleaning frame is increased.

According to the process cartridge and the electrophotographic image forming apparatus having such a cleaning frame, since the process cartridge can be installed in the vicinity of the fixing means, the main body of electrophotographic image forming apparatus can be made more compact.

What is claimed is:

1. A cleaning frame used in a process cartridge which is detachably mountable to a main body of an electrophotographic image forming apparatus, wherein the process cartridge includes an electrophotographic photosensitive drum, and a cleaning member for removing developer adhered to said electrophotographic photosensitive drum, said cleaning frame comprising:

a drum attaching portion for attaching said electrophotographic photosensitive drum;

a cleaning member attaching portion for attaching said cleaning member;

one end wall provided at one longitudinal end of said cleaning frame;

other end wall provided at other longitudinal end of said cleaning frame;

an exposure opening for receiving information light to be illuminated onto said electrophotographic photosensitive drum attached to said drum attaching portion when said process cartridge is mounted to the main body of said electrophotographic image forming apparatus; and a reinforcing member provided between said one end wall and said other end wall along the longitudinal direction of said cleaning frame, said reinforcing member being disposed at a side opposite to a side at which said exposure opening is provided in said cleaning frame in a direction transverse to the longitudinal direction of said cleaning frame, wherein a gap between said reinforcing member and a deep side wall opposed to said cleaning member attached to said cleaning member attaching portion at a side opposite to the side at which said exposure opening is provided in the direction transverse to the longitudinal direction of said cleaning frame is 0.5 mm to 3.0 mm.

2. A process cartridge which is detachably mountable to a main body of an electrophotographic image forming apparatus, comprising:

(a) a cleaning frame including:

a drum attaching portion for attaching an electrophotographic photosensitive drum;

a cleaning member attaching portion for attaching a cleaning member;

one end wall provided at one longitudinal end of said cleaning frame;

an other end wall provided at other longitudinal end of said cleaning frame;

an exposure opening for receiving information light to be illuminated onto said electrophotographic photosensitive drum attached to said drum attaching portion when said process cartridge is mounted to the main body of said electrophotographic image forming apparatus; and a reinforcing member provided between said one end wall and said other end wall along the longitudinal direction of said cleaning frame, said reinforcing member being disposed at a side opposite to a side at which said exposure opening is provided in said cleaning frame in a direction transverse to a longitudinal direction of said cleaning frame, wherein a gap between said reinforcing member and a deep side wall opposed to said cleaning member attached to said cleaning member attaching portion at the side opposite to the side at which said exposure opening is provided in the direction transverse to the longitudinal direction of said cleaning frame if 0.5 mm to 3.0 mm;

(b) said electrophotographic photosensitive drum attached to said drum attaching portion; and (c) said cleaning member attached to said cleaning member attaching portion.

3. A frame to which a cleaning member for removing developer on an image bearing member is attached, said frame comprising:

an attaching portion to which said cleaning member is attached; and a reinforcing member extended between side walls at opposed ends in a longitudinal direction of said frame and for reinforcing said frame, wherein said reinforcing member is disposed at a spaced position by 0.5 to 15.0 mm from a side wall opposite to a side at which said attaching portion is provided in said frame in a direction transverse to the longitudinal direction of said frame.

4. A frame according to claim 3, wherein said reinforcing member is disposed at a spaced position by 0.5 to 3.0 mm from said side wall opposite to said side at which said attaching portion is provided in said frame in the direction transverse to the longitudinal direction of said frame.

5. A frame according to claim 4, wherein among said side walls of said frame, said side wall opposite to said side at which said attaching portion is provided in said frame is nearest to a fixing means.

6. A frame according to claim 5, further comprising an attaching portion to which the image bearing member is attached, wherein said image bearing member is an electrophotographic photosensitive member.

7. A frame according to any one of claims 3 to 6, wherein said reinforcing member and said frame are made of resin.

8. A frame according to claim 7, wherein said reinforcing member is formed integrally with said frame.

9. A frame according to any one of claims 3 to 6, wherein said frame is made of resin and said reinforcing member is made of metal.

10. A frame according to any one of claims 3 to 6, wherein said frame is made of resin and said cleaning member is attached to said attaching portion through a metal member.

11. A frame according to claim 10, wherein said metal member is slidably attached to said frame.

12. A frame according to claim 11, wherein said metal member is fastened to said frame by a screw through a washer.

13. A process cartridge detachably mountable to a main body of an image forming apparatus, said process cartridge comprising:

a cleaning member for removing developer on an image bearing member;

a frame provided with an attaching portion to which said cleaning member is attached; and a reinforcing member extended between side walls at opposed ends in a longitudinal direction of said frame and for reinforcing said frame, wherein said reinforcing member is disposed at a spaced position by 0.5 to 15.0 mm from a side wall opposite to a side at which said attaching portion is provided in said frame in a direction transverse to the longitudinal direction of said frame.

14. A process cartridge according to claim 13, wherein said reinforcing member is disposed at a spaced position by 0.5 to 3.0 mm from said side wall opposite to said side at which said attaching portion is provided in said frame in the direction transverse to the longitudinal direction of said frame.

15. A process cartridge according to claim 14, wherein among said side walls of said frame, said side wall opposite to said side at which said attaching portion is provided in said frame is nearest to a fixing means.

16. A process cartridge according to claim 15, wherein the image bearing member is an electrophotographic photosensitive member and said frame is further provided with an attaching portion to which image bearing member is attached.

17. A process cartridge according to any one of claims 13 to 16, wherein said reinforcing member and said frame are made of resin.

18. A process cartridge according to claim 17, wherein said reinforcing member is formed integrally with said frame.

19. A process cartridge according to any one of claims 13 to 16, wherein said frame is made of resin and said reinforcing member is made of metal.

20. A process cartridge according to any one of claims 13 to 16, wherein said frame is made of resin and said cleaning member is attached to said attaching portion through a metal member.

21. A process cartridge according to claim 20, wherein said metal member is slidably attached to said frame.

22. A process cartridge according to claim 21, wherein said metal member is fastened to said frame by a screw through a washer.

23. A process cartridge according to any one of claims 13 to 16, wherein the developer removed by said cleaning member is collected in said frame.

24. An image forming apparatus for forming a developer image on a recording medium, said image forming apparatus comprising:

an image bearing member;

a cleaning member for removing developer on said image bearing member;

a frame provided with an attaching portion to which said cleaning member is attached; and a reinforcing member extended between side walls at opposed ends in a longitudinal direction of said frame and for reinforcing said frame, wherein said reinforcing member is disposed at a spaced position by 0.5 to 15.0 mm from a side wall opposite to a side at which said attaching portion is provided in said frame in a direction transverse to the longitudinal direction of said frame.

25. An image forming apparatus according to claim 24, wherein said reinforcing member is disposed at a spaced position by 0.5 to 3.0 mm from said side wall opposite to said side at which said attaching portion is provided in said frame in the direction transverse to the longitudinal direction of said frame.

26. An image forming apparatus according to claim 25, further comprising fixing means for heating the developer image formed on the recording material to fix the developer image on the recording material, wherein among said side walls of said frame, said side wall opposite to said side at which said attaching portion is provided in said frame is nearest to said fixing means.

27. An image forming apparatus according to claim 26, wherein said image bearing member is an electrophotographic photosensitive member and said frame is further provided with an attaching portion to which said image bearing member is attached.

28. An image forming apparatus according to any one of claims 24 to 27, wherein said reinforcing member and said frame are made of resin.

29. An image forming apparatus according to claim 28, wherein said reinforcing member is formed integrally with said frame.

30. An image forming apparatus according to any one of claims 24 to 27, wherein said frame is made of resin and said reinforcing member is made of metal.

31. An image forming apparatus according to any one of claims 24 to 27, wherein said frame is made of resin and said cleaning member is attached to said attaching portion through a metal member.

32. An image forming apparatus according to claim 31, wherein said metal member is slidably attached to said frame.

33. An image forming apparatus according to claim 32, wherein said metal member is fastened to said frame by a screw through a washer.

34. An image forming apparatus according to any one of claims 24 to 27, wherein the developer removed by said cleaning member is collected in said frame.

* * * * *

UNITED STATES PATENT AND TRADEMARK OFFICE

CERTIFICATE OF CORRECTION

PATENT NO. : 6,266,502 B1
DATED : July 24, 2001
INVENTOR(S) : Hiroomi Matsuaki et al.

It is certified that error appears in the above-identified patent and that said Letters Patent is hereby corrected as shown below:

Column 8,
Line 21, close up the right margin.
Line 22, close up the right margin.

Column 9,
Line 9, "129," should read -- 12*l*, --.
Line 11, "12*t*," should read -- 12*l*, --.
Line 44, "ecutive" should read -- an executive --.

Column 10,
Line 9, "molded-integrally" should read -- molded integrally --.

Column 11,
Line 17, "if" should read -- is --.

Column 12,
Line 7, "frame, wherein" should read -- frame, ¶ wherein --.

Signed and Sealed this

Twenty-first Day of May, 2002

*Attest:*

*Attesting Officer*

JAMES E. ROGAN
*Director of the United States Patent and Trademark Office*